US005335902A

United States Patent [19]

Suzuki

[11] Patent Number: 5,335,902

[45] Date of Patent: Aug. 9, 1994

[54] SHEET FEEDING DEVICE FOR AN IMAGE FORMING APPARATUS

[75] Inventor: Nobutaka Suzuki, Tokyo, Japan

[73] Assignee: Ricoh Company, Ltd., Tokyo, Japan

[21] Appl. No.: 29,607

[22] Filed: Mar. 11, 1993

[30] Foreign Application Priority Data

Mar. 13, 1992 [JP] Japan ..... 4-089726

[51] Int. Cl.[5] ..... B65H 3/52

[52] U.S. Cl. ..... 271/121; 271/167

[58] Field of Search ..... 271/121, 124, 167

[56] References Cited

U.S. PATENT DOCUMENTS 4,844,437 7/1989 Tanaka et al. ..... 271/124

FOREIGN PATENT DOCUMENTS 280210 8/1988 European Pat. Off. ..... 271/121

62-295841 12/1987 Japan ..... 271/121

63-300038 12/1988 Japan ..... 271/121

281834 3/1990 Japan ..... 271/121

2138041 5/1990 Japan ..... 271/121

3249037 11/1991 Japan ..... 271/121

*Primary Examiner*—David H. Bollinger

*Attorney, Agent, or Firm*—Oblon, Spivak, McClelland, Maier & Neustadt

[57] ABSTRACT

A sheet feeding device for an image forming apparatus A plurality of blades have their edges pressed against a feed roller by springs to increase the force obstructing the transport of sheets while reducing the force pressing sheets. As a result, the force with which the sheets press against each other is reduced. This is successful in easily separating a single sheet from the others and, when two-sided recording sheets are fed, preventing them from rubbing against and degrading each other.

6 Claims, 9 Drawing Sheets

SHEET FEEDING DEVICE FOR AN IMAGE FORMING APPARATUS

BACKGROUND OF THE INVENTION

The present invention relates to a sheet feeding device for a printer, copier, facsimile apparatus, printer or similar image forming apparatus.

An image forming apparatus of the kind described includes an image reader for reading a document image, and a sheet supply mechanism for feeding a recording sheet to reproduce the document image thereon. The image reader and sheet supply mechanism are each provided with a sheet feeding device for feeding documents or sheets one by one by separating them. Usually, the sheet feeding device includes a pick-up roller for picking up documents or sheets, a teed roller to which the documents or sheets picked up are fed, and a blade pressed against the feed roller at the edge thereof. The documents or sheets driven by the pick-up roller are brought to between the feed roller and the edge of the blade to be separated one by one.

Since the blade is made of an elastic material, it bends with the edge thereof pressing against the feed roller. Therefore, the angle between the blade and the feed roller for transporting documents of sheets is reduced by an angle corresponding to the bend of the blade. As a result, a force acting on, among two documents or sheets fed, the second document or sheet due to the force of the blade is greater than a force preventing the second document or sheet from being fed, i.e., separating the first sheet from the second sheet. As a result, the second sheet is strongly pressed against the first sheet, obstructing the separation of the first sheet. Moreover, in the case of two-sided documents each carrying an image on both sides thereof, they strongly rub against each other to degrade their images.

SUMMARY OF THE INVENTION

It is, therefore, an object of the present invention to provide a sheet feeding device for an image forming apparatus which is capable of feeding sheets while surely separating them one by one and preventing sheets carrying images from rubbing against each other.

A sheet feeding device for feeding sheets one by one in a predetermined direction of the present invention comprises a feed roller, a pick-up roller for picking up the sheets and feeding the sheets toward the feed roller, and at least one blade rotatable about a fulcrum and held in contact with the surface of the feed roller at an edge thereof.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
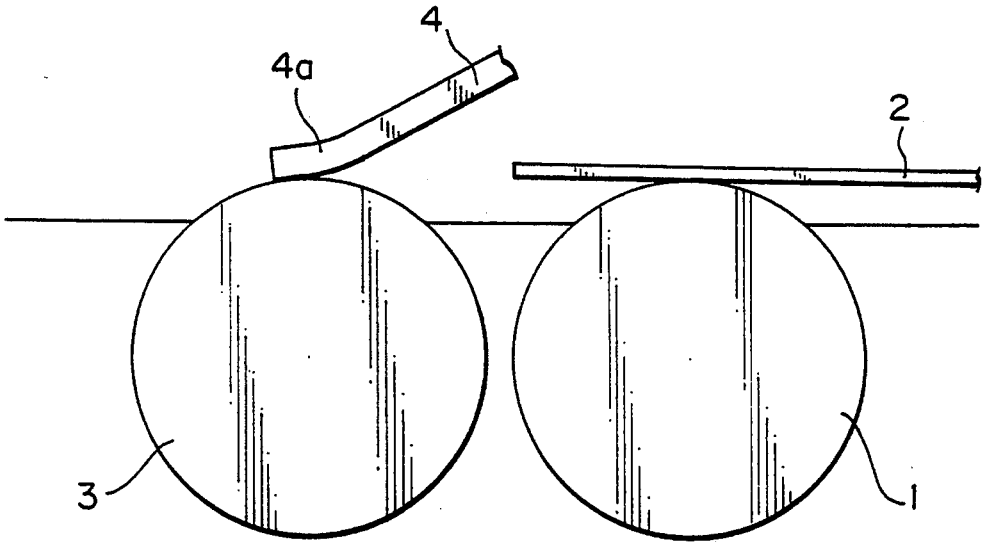
Fig. 1 PRIOR ART
FIG. 1 is a section showing a conventional sheet feeding device.
Figure 2:
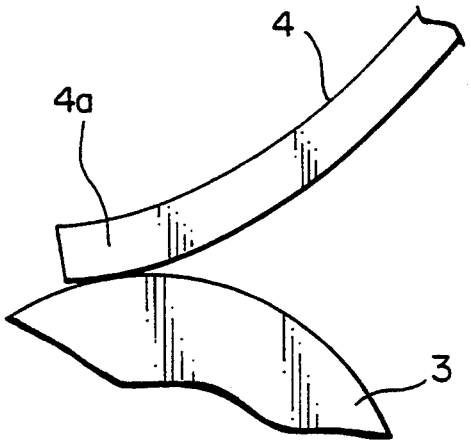
Fig. 2 PRIOR ART
FIG. 2 is a fragmentary enlarged view of the device shown in FIG. 1.
Figure 3:
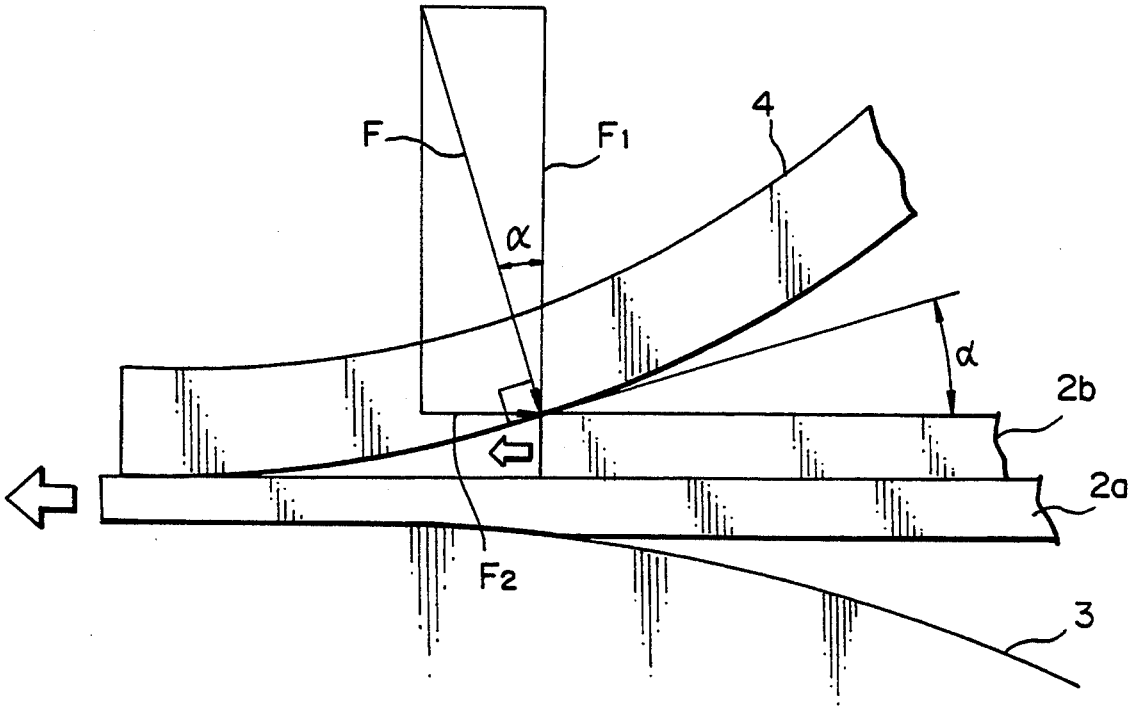
Fig. 3 PRIOR ART
FIG. 3 shows a condition in which the conventional device separates sheets.
Figure 4:
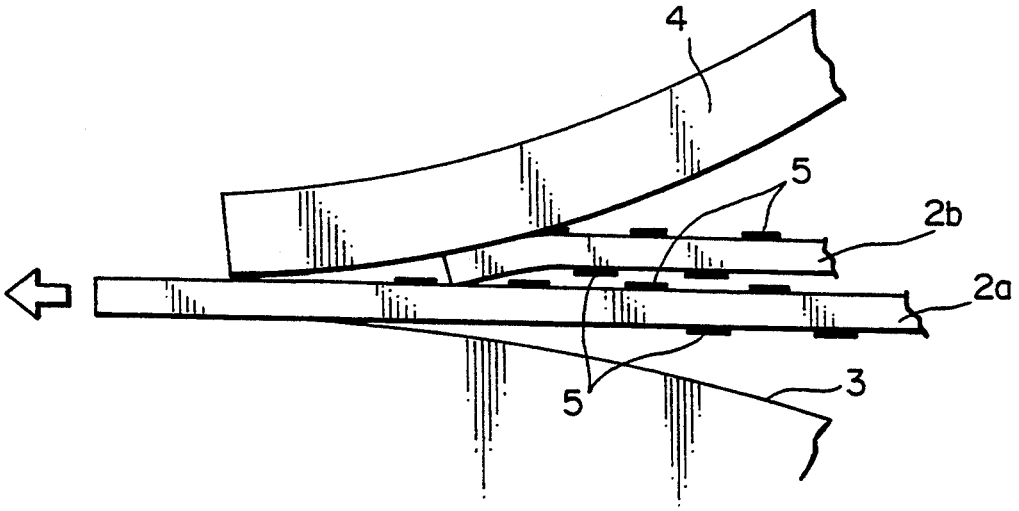
Fig. 4 PRIOR ART
FIG. 4 shows a condition in which the conventional device separates two-sided recording sheets.

To better understand the present invention, a brief reference will be made to a prior art sheet feeding device, shown FIG. 1. As shown, the sheet feeding device has a pick-up roller 1, a feed roller 3 to which document or recording sheets, or simply sheets, 2 are fed from the pick-up roller 1, and a blade 4 contacting the feed roller 3 at the free edge 4*a* thereof. The other or base edge of the blade 4 is affixed to a stationary member included in the device. Since the blade 4 is made of an elastic material, it bends with the edge 4*a* thereof pressing against the teed roller 3, as best shown in FIG. 2. This is undesirable as will be described with reference to FIG. 3. In FIG. 3, there are schematically shown a sheet 2*a* to be fed first and a sheet 2*b* overlying the sheet 2*a*. The angle $\alpha$ between the top of the sheets 2 and the surface of the blade 4 contacting the sheet 2*a* is reduced by an angle corresponding to the bend of the blade 4. As a result, a force F1 acting on the sheet 2*b* due to the force F of the blade 4 is greater than a force F2 preventing the sheet 2*b* from being fed, i.e., separating the sheet 2*a* from the sheet 2*b*. A s a result, the sheet 2*b* is strongly pressed against the sheet 2*a*. This is apt to prevent the sheet 2*a* from being separated from the sheet 2*b*, causing both of the sheets 2*a* and 2*b* to be fed together. Furthermore, assume that the sheets 2*a* and 2*b* are two-sided documents each carrying an image formed by a toner or ink 5 on both sides thereof. Then, since the sheets 2*a* and 2*b* strongly rub against each other in the above condition, it is likely that the ink or toner 5 is shaved off to degrade the images.

Figure 5:
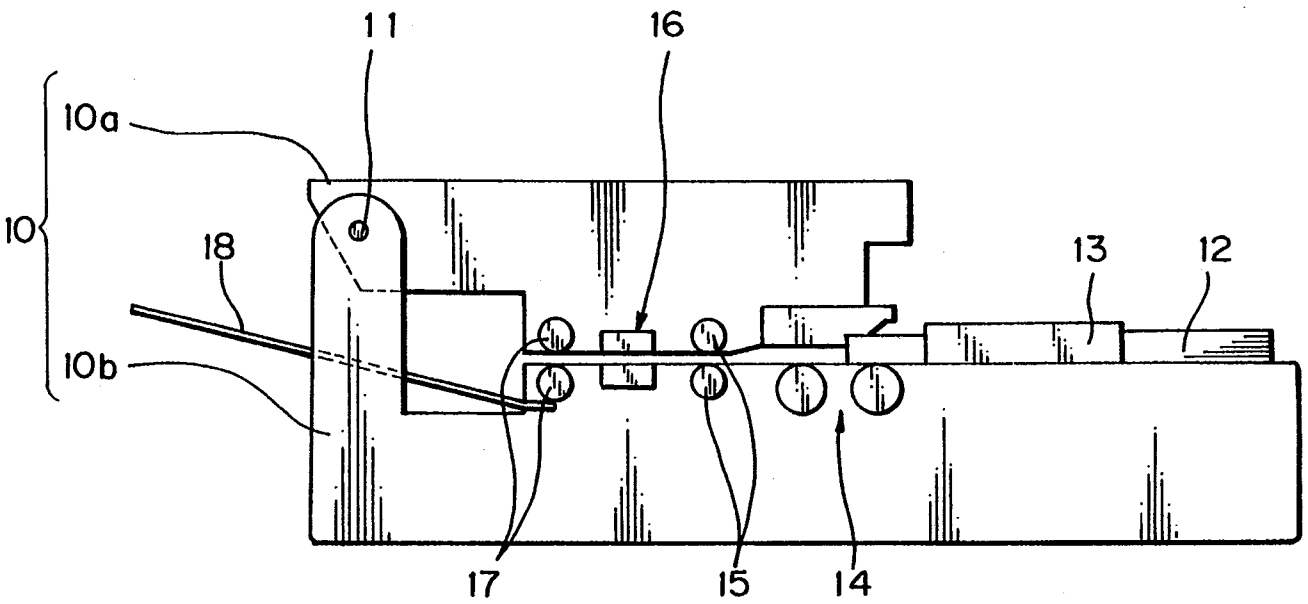
FIG. 5 is a section showing the general construction of an image reader implemented with a sheet feeding device embodying the present invention.

Referring to FIG. 5, an image reader implemented with a sheet feeding device embodying the present invention is shown. As shown, the image reader has a body 10 made up of upper body part 10*a* and lower body part 10*b*. The upper body part 10*a* is hinged to the lower body part 10*b* in such a manner as to be rotatable, or openable, about a fulcrum 11 away from the lower body part 10*b*. A pair of side guides (only one is visible) 13 are provided on the top of the lower body part 10*b* and at the right-hand side as viewed in the figure so as to hold a stack of documents 12 from both sides. A sheet feeding device 14, a front transfer roller pair 15, an image sensor 16, and a rear transfer roller pair 17 are sequentially arranged in this order in an intended direction of sheet feed, i.e., from the right to the left as viewed in the figure. A tray 18 protrudes from the body 10 to the outside.

Figure 6:
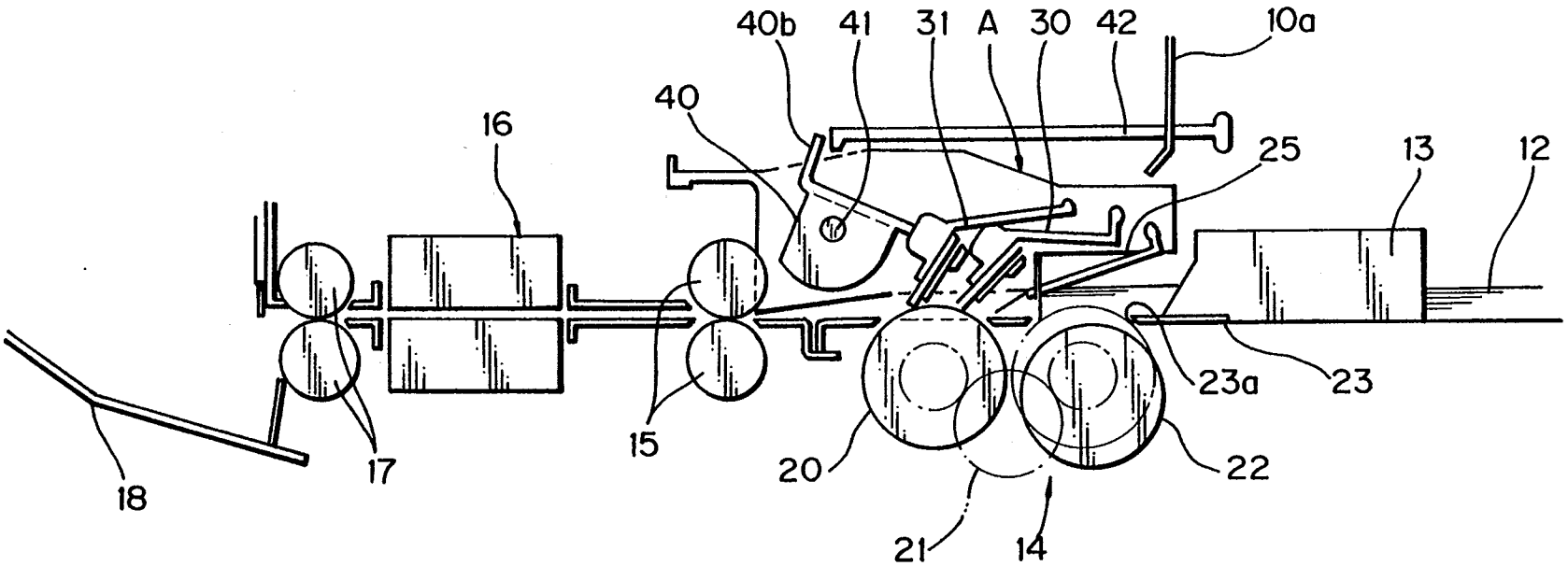
FIG. 6 is a fragmentary enlarged view of the image reader shown in FIG. 5.

As shown in FIG. 6, the sheet feeding device 14 has a feed roller 20 rotatably mounted on the lower body part 10*b*. An idler gear 21 and a pick-up roller 22 are also rotatably mounted on the lower body part 10*b* at the side of the teed roller 20 close to the side guide 13. The idler gear 21 is held in mesh with a gear provided on the feed roller 20 and a gear provided on the pick-up roller 22. A lower guide plate 23 is included in the lower body part 10*b* and formed with an opening 23*a*. The pick-up roller 22 is movable up and down about the axis of rotation of the idler gear 21, protruding from the opening 23*a* when moved upward.

Figure 7:
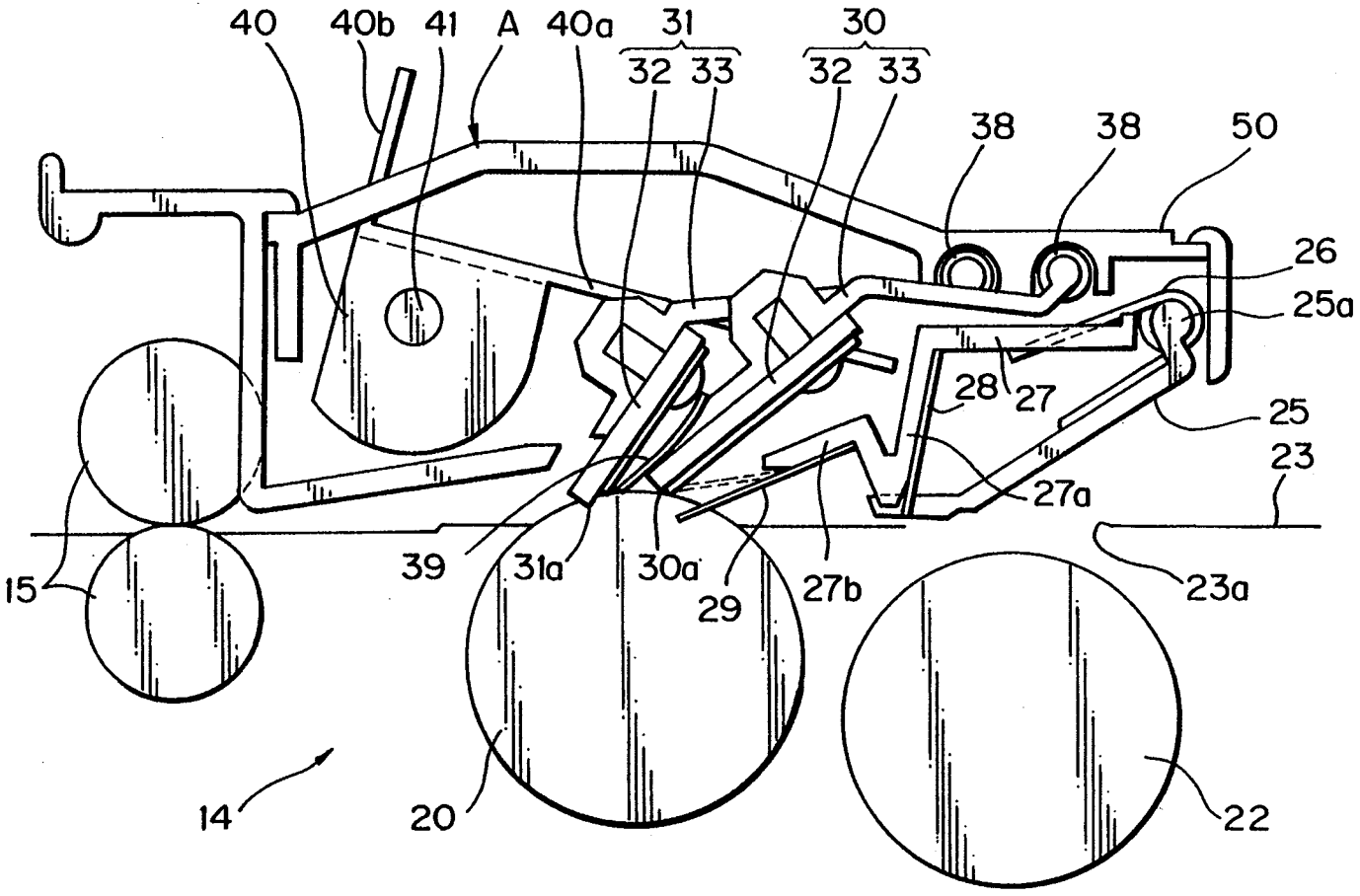
FIG. 7 is a section showing the sheet feeding device embodying the present invention.
Figure 8:
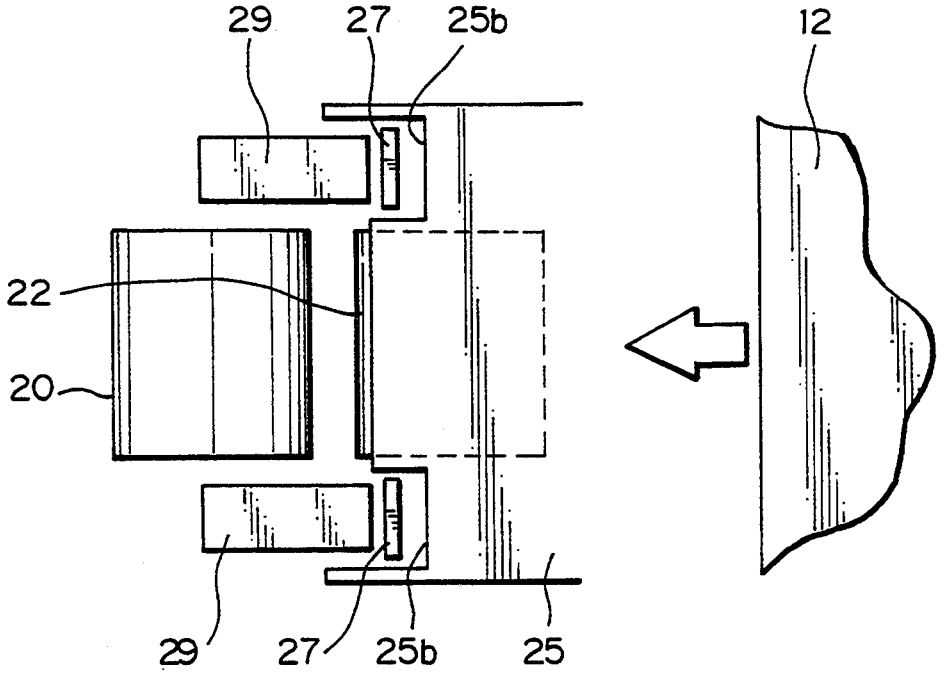
FIG. 8 is a plan view of the embodiment.
Figure 9:
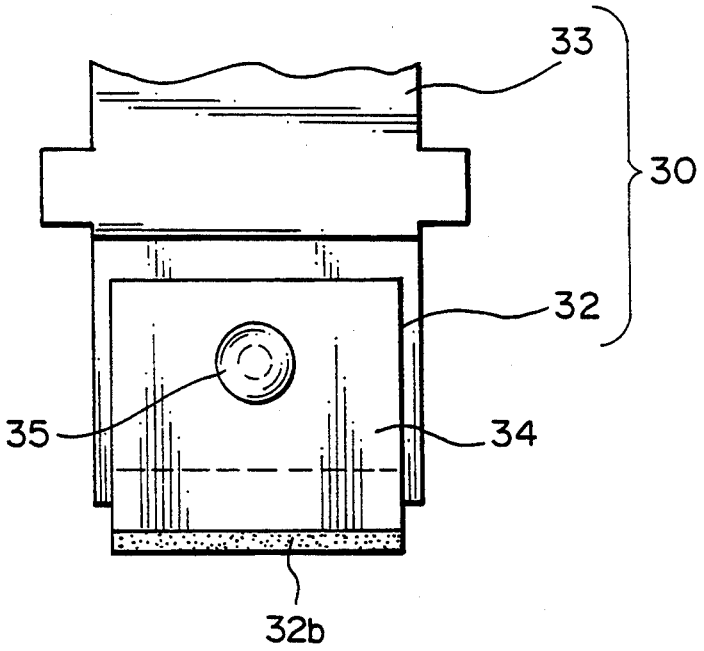
FIG. 9 is a fragmentary side elevation of one of a plurality of blades included in the embodiment.

The sheet feeding device 14 will be described in more detail with reference to FIGS. 7–11. As shown in FIG. 7, a pressure plate 25 has a substantial width and has one end 25*a* thereof rotatably mounted on a support member 50. The pressure plate 25 extends from the support member 50 in a downward leftward inclined position. A coil spring 26 constantly biases the pressure plate 25 toward the pick-up roller 22. As shown in FIG. 8, notches 25*b* are formed in the free end of the pressure plate 25 at both sides of a central portion. A stop 27 has the free end thereof received in the notches 25*b* and located in close proximity to the lower guide plate 23.

Referring again to FIG. 7, the stop 27 is formed integrally with the support member 26. The stop 27 includes an intermediate portion 27*a* bent downward toward the lower guide plate 23, and an end portion 27*b* bent in the sheet feed direction in a form of a letter L, as illustrated. A stop film 28 is implemented as a polyester film and adhered to the intermediate portion 27*a* of the stop 27 by a two-sided adhesive tape. A document presser 29 is also implemented as a polyester film and adhered to the end portion 27*b* of the stop 27 by a two-sided adhesive tape. The free end of the document presser 29 is located at both sides of the feed roller 20, as viewed in FIG. 8.

Figure 10:
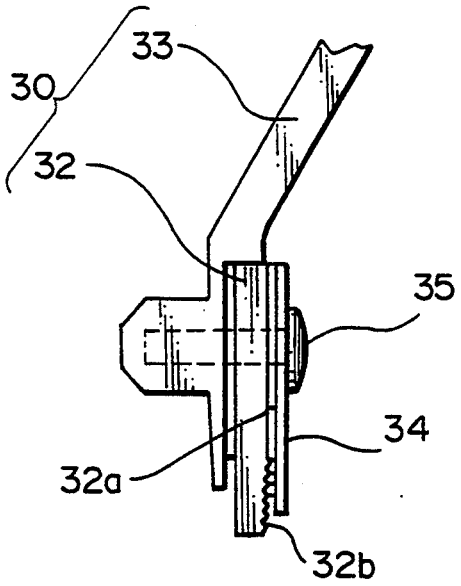
FIG. 10 is a fragmentary side elevation of the blade shown in FIG. 9.

Two blades 30 and 31 are held in contact with the feed roller 20 and spaced apart from each other in the sheet feed direction. The blades 30 and 31 each has a blade portion 32 and a holder portion 33. As best shown in FIG. 10, the blade portion 32 is flat and formed with fine undulations 32*b* at the end portion of one side 32*a* thereof. The blade portion 32 with such a configuration is adhered to the end of the holder portion 33 by a two-sided adhesive tape with the undulations 32*b* facing backward with respect to the sheet feed direction. The blade portion 32 is covered with a polyester film 34. The polyester film 34 and blade portion 32 are fastened together to the holder portion 33 by a tapping screw 35. The holder portion 33 is bent downward in a form of a letter L.

Figure 11:
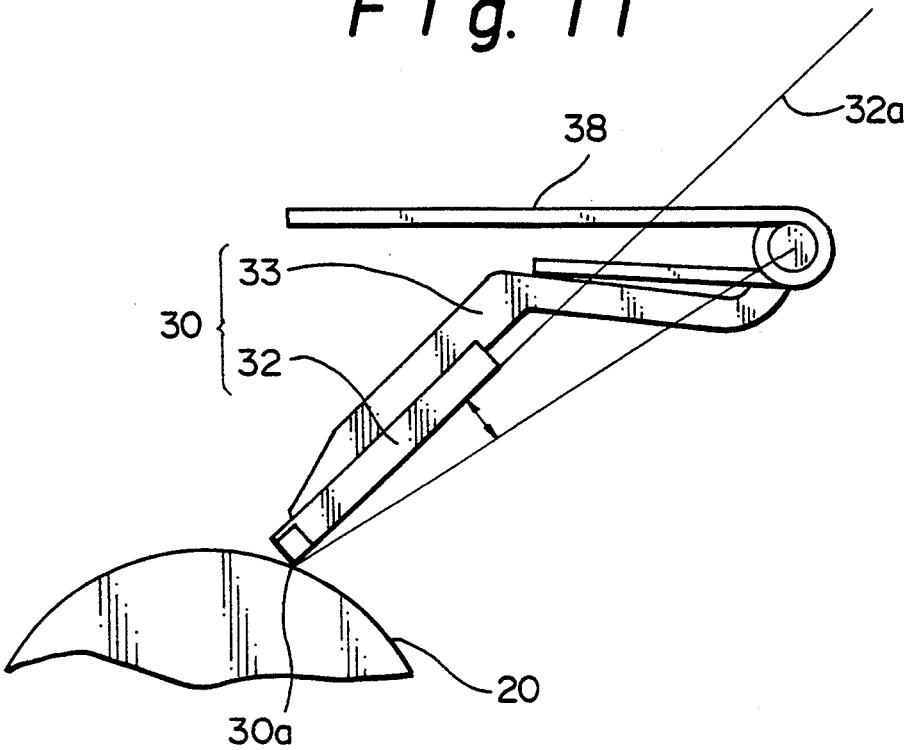
FIG. 11 shows an arrangement for mounting the blade.

As shown in FIG. 11, the blade 30 is mounted on the support member 26 in such a manner as to be rotatable about a fulcrum X located in front of the above-mentioned side 32*a* of the blade portion 32 with respect to the sheet feed direction. A coil spring 38 constantly biases the blade 30 such that the edge 30*a* of the blade 30 is pressed against the feed roller 20. Likewise, the blade 30 has the edge 31*a* thereof pressed against the feed roller 20.

As shown in FIG. 7, a guide film 39 is interposed between the blades 30 and 31 and adhered at one end thereof to the right blade 30, as viewed in the figure, by a two-sided adhesive tape. The other end of the guide film 39 is pressed against the feed roller 20. These members including the blades 30 and 31 constitute a separation unit A which is removably mounted on the upper body part 10*a*.

As also shown in FIG. 7, a release or unpressure member 40 is rotatably mounted on the support member 26 by a shaft 41 and engaged with the blades 30 and 31 at one end 40*a* thereof. The other end 40*b* of the release member 40 is protruded to the outside of the separation unit A. The release member 40 is capable of lifting the blades 30 and 31, as will be described. As shown in FIG. 6, a lever 42 is mounted on the upper body part 10*a* and movable in the right-and-left direction as viewed in the figure, i.e., into and out of contact with the end 40*b* of the release member 40.

The sheet feeding device 14 having the above construction will be operated as follows.

As shown in FIG. 6, the documents 12 are stacked on the lower guide plate 23, positioned by the side guides 13 at both sides thereof, and then pressed toward the pick-up roller 22 by the pressure plate 25. Then, a drive force generated by a drive source, not shown, is transmitted to the feed roller 20 via an adequate train to rotate it counterclockwise, as viewed in the figure. At the same time, the drive force is imparted to the pick-up roller 22 by the idler gear 21 to rotate it counterclockwise. At this instant, the pick-up roller 22 is raised about the axis of rotation of the idler gear 21 to abut against the underside of the stack of documents 12. As a result, a plurality of documents 12 are driven while being regulated by the stop 28.

Figure 12:
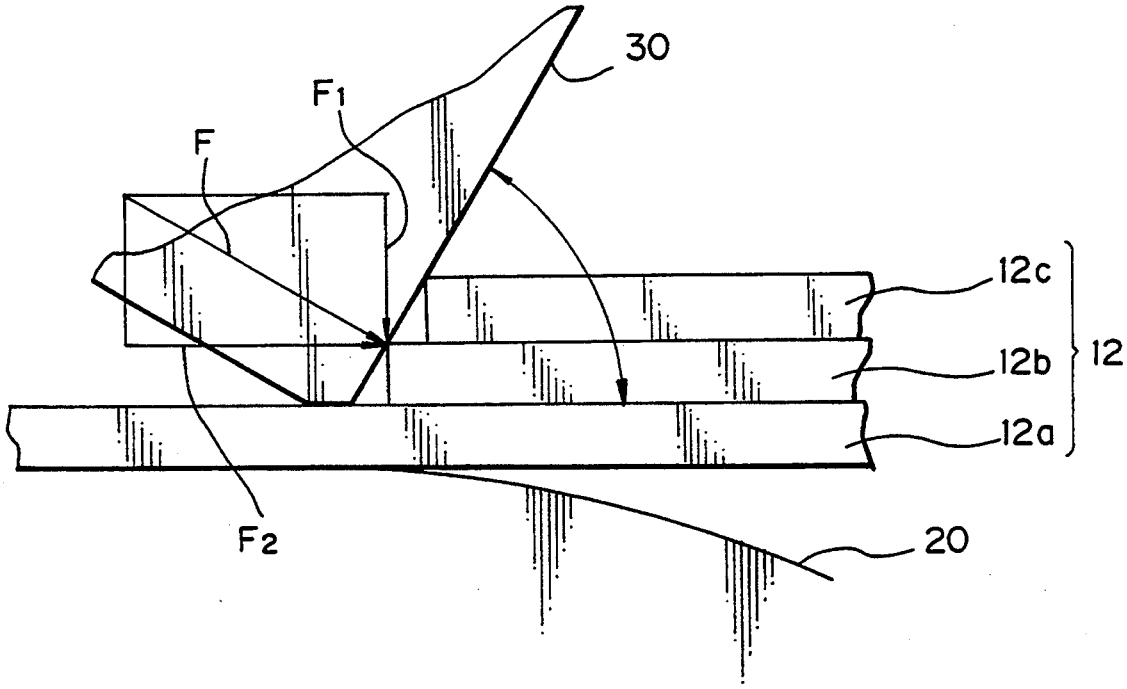
FIG. 12 demonstrates how the blade separates documents.

As the plurality of documents 12 are brought to between the feed roller 20 and the blade 30, they are pressed against the feed roller 20 by the document presser 29 and, at the same time, abutted against the blade 30. Then, the feed roller 20 in rotation feeds the documents 12 in the sheet feed direction. At this instant, as also shown in FIG. 12, the blade 30 separates the first or lowermost document 12*a* from the second or overlying document 12*b*. The separation is easy since a force F1 acting on the overlying document 12*b* due to the force F of the blade 30 is smaller than a force F2 obstructing the transport and, therefore, prevents the document 12*b* from strongly pressing against the document 12*a*. Also, the documents 12*a* and 12*b* are prevented from strongly rubbing against each other. Subsequently, as shown in FIG. 6, the document 12 separated from the others is transported by the front transport roller pair 15 to the image sensor 16. After the document 12 has been read by the image sensor 16, it is driven by the rear transport roller pair 17 and then stacked on the tray 18.

Figure 13:
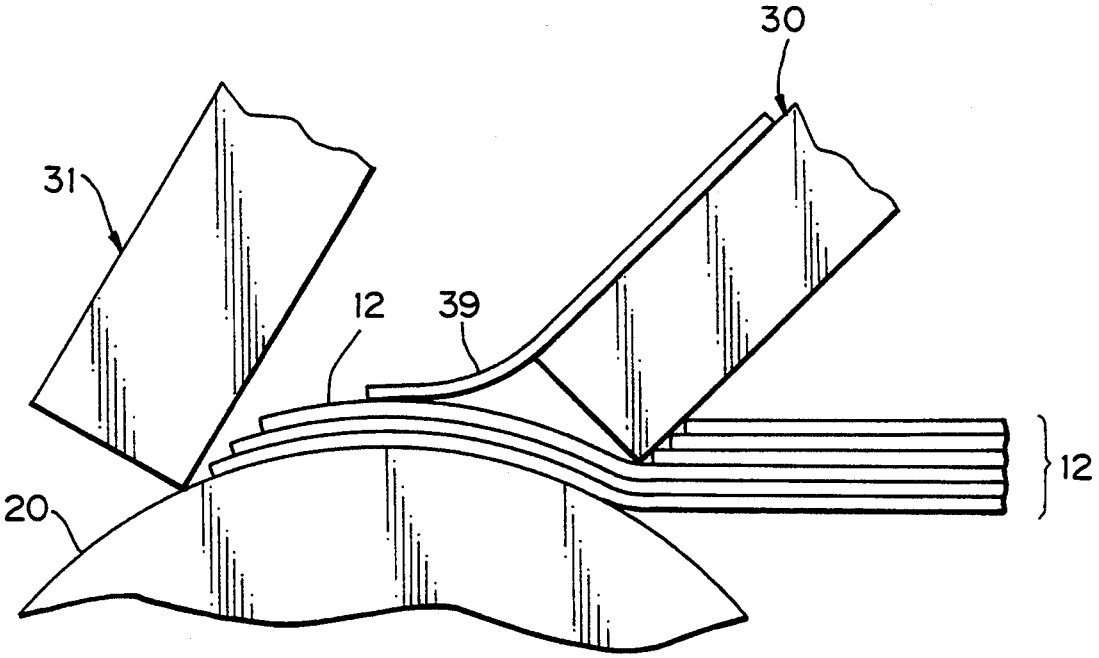
FIG. 13 demonstrates how the plurality of blades separate documents.

As shown in FIG. 13, assume that the blade 30 has failed to separate the lowermost document from the others. Then, the documents 12 are brought to between the next blade 31 and the feed roller 20 while being pressed against the roller 20. Since the documents 12 are loosened as they proceed along the circumference of the feed roller 20, the blade 31 extremely easily separates the lowermost document 12 from the others.

Figure 14:
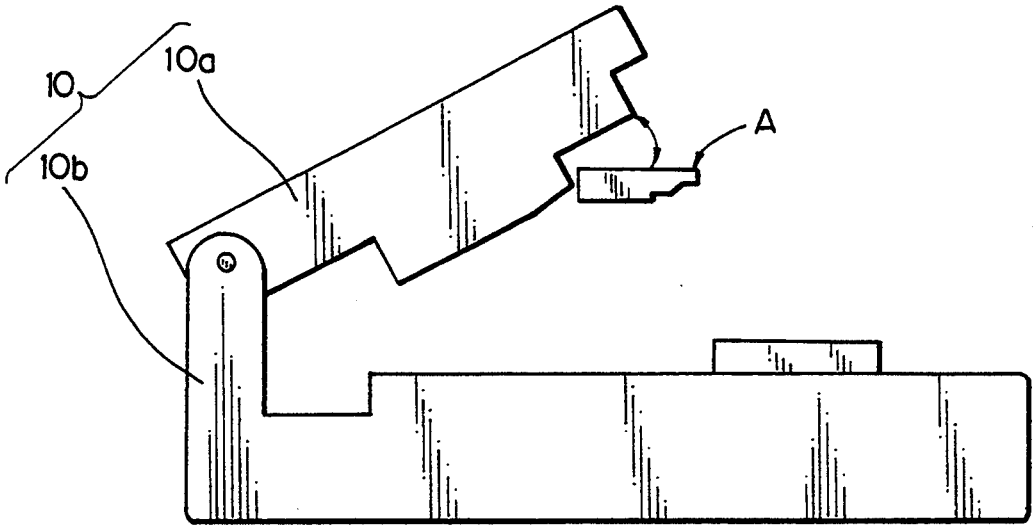
FIG. 14 shows how to replace a separation unit included in the embodiment.

As shown in FIG. 14, the upper body part 10*a* is openable to replace the separation unit A from another separation unit matching the material and size of documents to be dealt with.

When the operator desires to feed the documents 12 one after another by hand, the operator presses the lever 42, FIG. 6, until it abuts against the end 40*b* of the release member 40. Then, the release member 40 is rotated counterclockwise about the shaft 41 to lift the blades 30 and 31 away from the feed roller 20.

In summary, it will be seen that the present invention provides a sheet feeding device capable of easily separating a single sheet from the others and, when two-sided recording sheets are fed, preventing them from rubbing against and degrading each other. This is because the edges of a plurality of blades are pressed against a feed roller by springs to increase the force obstructing the transport while reducing the force pressing sheets. The plurality of blades further enhances positive separation of sheets. When the preceding one of the blades fails to separate sheets, the following blade surely and easily separates them since the sheets are brought to between it and the feed roller while being pressed against the roller by a guide film. The blades and a presser member cooperate to promote the smooth transport of sheets. In the event of manual sheet feed, a release member i s operated to release the blades from the feed roller, thereby allowing sheets to be fed smoothly by hand. In addition, a particular separation unit matching the kind of sheets can be removably mounted to set up an optimal separation condition.

Various modifications will become possible for those skilled in the art after receiving the teachings of the present disclosure without departing from the scope thereof.

What is claimed is:

1. A sheet feeding device for feeding sheets one by one in a predetermined direction, comprising:

a feed roller;

a pick-up roller for picking up the sheets and feeding said sheets toward said feed roller;

a first blade rotatable about a fulcrum and held in contact with a surface of said feed roller at an edge of said first blade, and wherein means for urging said first blade against said feed roller are provided such that only said edge is held against said feed roller without remaining portions of said first blade deforming into pressing relation with said feed roller; and a second blade held in contact with a surface of said feed roller at a location downstream from a location at which said edge of said first blade contacts said feed roller with respect to a feeding direction of the sheets, and wherein means for urging said second blade against said feed roller are provided to hold only an edge of said second blade against said feed roller without remaining portions of said second blade deforming into pressing relation with said feed roller.

2. A device as claimed in claim 1, further comprising pressure members located at both sides of said first blade for urging the sheets against said feed roller.

3. A device as claimed in claim 1, further comprising a release member for releasing said first blade and said second blade from said feed roller when the sheets are to be fed by hand.

4. The sheet feeding device of claim 1, wherein at least said first blade includes a surface facing rearwardly with respect to a sheet feeding direction, said surface including undulations formed thereon.

5. A sheet feeding device for feeding sheets one by one in a predetermined direction comprising;.

a feed roller;

a pick-up roller for picking up the sheets and feeding said sheets toward said feed roller;

a plurality of blades spaced apart in an intended direction of sheet feed, and wherein said plurality of blades are held in contact with a surface of said feed roller;

the sheet feeding device further comprising a flexible guide film interposed between said plurality of blades for urging the sheets against the feed roller.

6. A sheet feeding device for feeding sheets one by one in a predetermined direction, comprising:

a feed roller;

a pick-up roller for picking up the sheets and feeding said sheets towards said feed roller; and at least one blade rotatable about a fulcrum and held in contact with a surface of said feed roller at an edge of said at least one blade, said blade including a surface facing rearwardly with respect to a sheet feeding direction, said surface including undulations formed thereon.

* * * * *